US006958700B2

(12) United States Patent
Yoshida et al.

(10) Patent No.: US 6,958,700 B2
(45) Date of Patent: Oct. 25, 2005

(54) FIRE RECEIVER

(75) Inventors: Minoru Yoshida, Tokyo (JP); Munehiro Onji, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 88 days.

(21) Appl. No.: 10/218,657

(22) Filed: Aug. 15, 2002

(65) Prior Publication Data

US 2003/0038726 A1 Feb. 27, 2003

(30) Foreign Application Priority Data

Aug. 22, 2001 (JP) ..... 2001-251237
Aug. 22, 2001 (JP) ..... 2001-251238

(51) Int. Cl.[7] ..... G08B 5/00

(52) U.S. Cl. ..... 340/691.3; 340/628; 340/525; 345/204

(58) Field of Search ..... 340/691.3, 628, 340/629, 630, 525, 524, 506; 345/204

(56) References Cited

U.S. PATENT DOCUMENTS 3,651,511 A * 3/1972 Andrews et al. ..... 345/691
4,752,771 A * 6/1988 Katogi et al. ..... 345/88
4,929,936 A 5/1990 Friedman et al. ..... 345/618
5,057,818 A 10/1991 Tennefoss ..... 340/525
5,583,484 A * 12/1996 Asano ..... 340/461
5,760,760 A * 6/1998 Helms ..... 345/102
5,933,130 A * 8/1999 Wagner ..... 345/690
5,952,992 A * 9/1999 Helms ..... 345/102
6,259,981 B1 * 7/2001 Wilcosky ..... 701/29
6,448,955 B1 * 9/2002 Evanicky et al. ..... 345/102
6,471,087 B1 * 10/2002 Shusterman ..... 221/2

FOREIGN PATENT DOCUMENTS

CN 87213226 U 3/1988
CN 2382076 Y 6/2000
EP 0 716 401 6/1996

OTHER PUBLICATIONS

Patent Abstracts of Japan, entitled "*Radio Selection Call Receiver*", vol. 1999, No. 10, Aug. 31, 1999.

* cited by examiner

*Primary Examiner*—Phung T. Nguyen
(74) *Attorney, Agent, or Firm*—Wenderoth, Lind & Ponack, L.L.P.

(57) ABSTRACT

A fire receiver includes a light emitting device; a supervisory control apparatus for performing supervisory control based on information from a plurality of terminal devices such as fire detectors, and for displaying the information by causing the light emitting device to emit light; and a brightness changing device for changing the brightness of the light emitting device in response to the brightness of the surrounding environment.

16 Claims, 5 Drawing Sheets

FIG. 4A

IN JAPANESE

平常監視
スタンバイメッセージ
09:00AM 12/12/2000

IN ENGLISH

SYSTEMS NORMAL
(・・・・SYANDBY ・・・・)
(・・・・MESSAGE ・・・・)
09:00AM 12/12/2000

FIG. 4B

IN JAPANESE

プレアラーム ADDR.L3-03
光電アナログ感知器
客室505号室
09:00AM 04/12/00

IN ENGLISH

PRE-ALARM ADDR.L3-03
ANALOG SMOKE DETECTOR
GUEST ROOM NUMBER 505
09:00AM 04/12/00

FIG. 4C

IN JAPANESE

蓄積 ADDR.L3-03
光電アナログ感知器
客室505号室
09:00AM 04/12/00

IN ENGLISH

VERIFY ADDR.L3-03
ANALOG SMOKE DETECTOR
GUEST ROOM NUMBER 505
09:00AM 04/12/00

FIG. 4D

IN JAPANESE

火災 ADDR.L3-03
光電アナログ感知器
客室505号室
09:00AM 04/12/00

IN ENGLISH

FIRE ADDR.L3-03
ANALOG SMOKE DETECTOR
GUEST ROOM NUMBER 505
09:00AM 04/12/00

FIG. 4E

IN JAPANESE

無応答 ADDR.L3-03
光電アナログ感知器
客室505号室
09:00AM 04/12/00

IN ENGLISH

NO ANSWER ADDR.L3-03
ANALOG SMOKE DETECTOR
GUEST ROOM NUMBER 505
09:00AM 04/12/00

FIRE RECEIVER

BACKGROUND OF THE INVENTION

1. Field of the Invention

The present invention relates to a fire receiver.

2. Description of the Related Art

A conventional fire receiver is normally installed in a building management office, a fire control center, or the like. Light emitting means such as lamps for performing various types of display are located on a surface of the fire receiver, along with a display portion which displays a variety of information such as the existence of a normal monitoring state, detector type, and occurrence of a fire. The brightness in the vicinity of the fire receiver is nearly constant in the management office and in the fire control center, and monitoring of corresponding zones can be performed by looking at the lamps, the display portion, or the like.

For cases in which the fire receiver is mounted in a ship, it is often installed in the pilothouse, but the brightness within the pilothouse changes greatly between day and night. The inside of the pilothouse is maintained in a dark state so as to be able to see the outside through glass windows in the pilothouse for cases in which the ship sails during the night. If light emitting devices such as lamps on the fire receiver exist within the pilothouse, then light from the lamps and the like will be reflected by the glass windows of the pilothouse, and enter the field of vision of the ship's pilot, making navigation more difficult.

However, the brightness of the light emitting means disposed on the surface of a conventional fire receiver cannot be controlled from outside of the fire receiver, and therefore the navigation difficulties cannot be eliminated.

Further, it is sufficient to make the display portion of the fire receiver display in Japanese for cases in which the fire receiver is normally used within Japan. However, there is a problem for cases in which the fire receiver is installed in a ship, or the like, in that it is often difficult for non-Japanese crew members to understand the display if the display portion only displays Japanese, which is inconvenient. This problem develops similarly outside of the environment of a ship, for example, if the fire receiver is installed in a company or the like that has a large number of non-Japanese employees.

SUMMARY OF THE INVENTION

An object of the present invention is to provide a fire receiver in which the brightness of light emitting means such as a display light or an LCD display in the fire receiver can be adjusted from outside the fire receiver, and in addition, the brightness adjustment operation is easy.

Further, another object of the present invention is to provide a fire receiver in which display content of the fire receiver is easily understood by non-Japanese operators for cases in which the fire receiver is installed in an environment under which it must be operated or monitored by the non-Japanese as well as the Japanese.

According to a first aspect of the present invention, there is provided a fire receiver comprising: light emitting means; supervisory control means for performing supervisory control based on information from a plurality of terminal devices such as fire detectors, and for displaying the information by causing the light emitting means to emit light; and brightness changing means for changing the brightness of the light emitting means in response to the brightness of the surrounding environment.

According to a second aspect of the present invention, there is provided a fire receiver comprising: light emitting means; language setting means for selecting one language from among a plurality of languages set up in advance; and supervisory control means for performing supervisory control based on information from a plurality of terminal devices such as fire detectors, and for displaying the information in the displaying means, and in the language set by the language setting means.

BRIEF DESCRIPTION OF THE DRAWINGS

FIGS. 4A to 4E are diagrams showing examples of information displayed in a display portion in Embodiment 1.

DETAILED DESCRIPTION OF THE PREFERRED EMBODIMENTS

Figure 1:
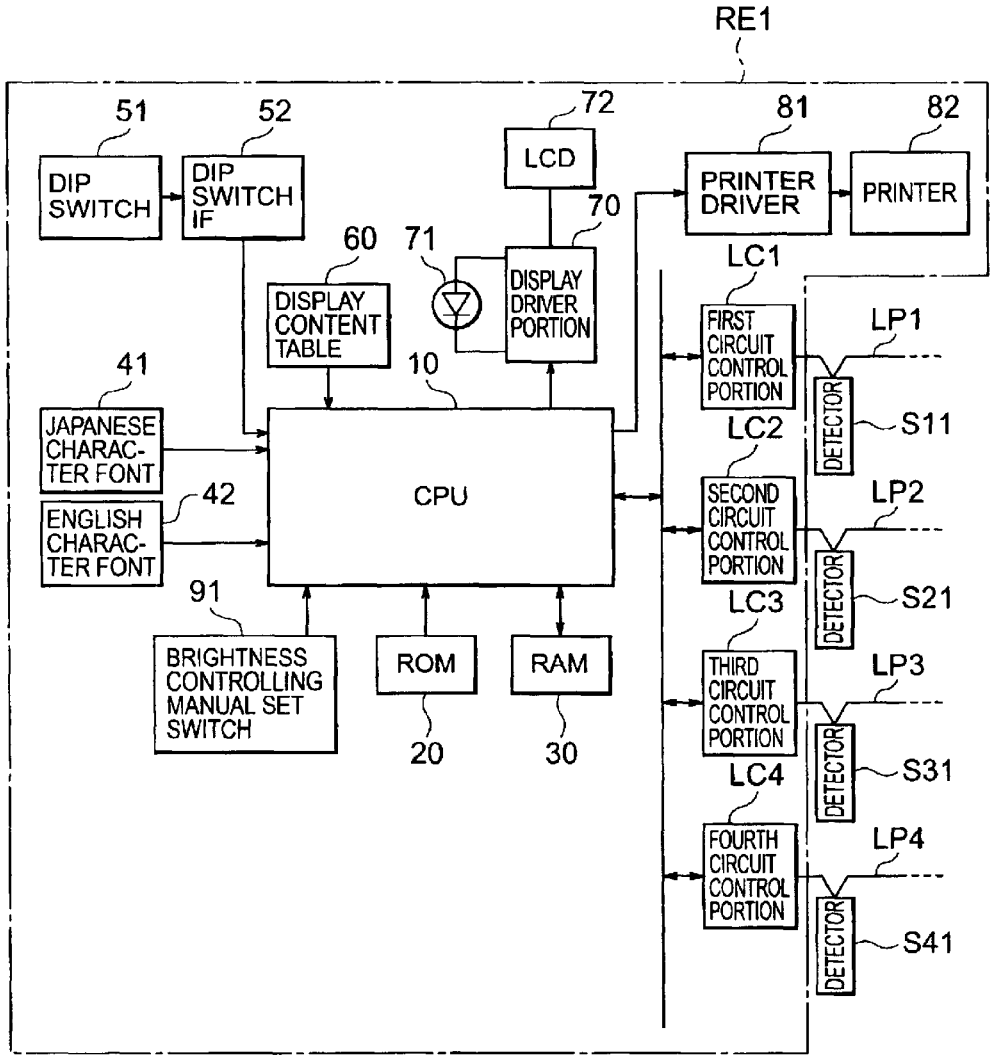
FIG. 1 is a block diagram showing the structure of a fire receiver RE1 according to Embodiment 1 of the present invention.

Embodiment 1:

FIG. 1 is a block diagram showing the structure of a fire receiver RE1 according to Embodiment 1 of the present invention. The fire receiver RE1 has a bilingual system capable of displaying Japanese and English texts in a display portion by using an LCD 72 on the surface of the fire receiver, which is used in a ship.

The fire receiver RE1 performs supervisory control on an overall fire alarm equipment including a plurality of fire detectors, and has: a CPU (central processing unit) 10; a ROM 20; a RAM 30; a Japanese character font 41; an English character font 42; a dip switch 51; a dip switch IF 52; a display content table 60; a display driver portion 70; a display light 71; the LCD 72; a printer driver 81; a printer 82; and a brightness controlling manual set switch 91.

Further, the fire receiver RE1 has: a first circuit control portion LC1; a second circuit control portion LC2; a third circuit control portion LC3; and a fourth circuit control portion LC4. The circuit control portions LC1, LC2, LC3 and LC4 are connected to detectors S11, S21, 531 and S41, respectively, through signal lines LP1, LP2, LP3 and LP4 formed in a loop circuit.

The CPU 10 is for controlling the overall fire receiver RE1, the ROM 20 is a memory in which a computer program making the CPU 10 operate the fire receiver RE1 (described later) is stored, and the RAM 30 is a working memory. Note that the words such as "Systems Normal", "Fire" and "Verify", which are described later, are stored inside the computer program.

The Japanese character font 41 and the English character font 42 are stored in a data storage portion not shown in FIG. 1.

The circuit control portions LC1, LC2, LC3 and LC4 perform supervisory control of information regarding fires and the like from a plurality of terminal devices.

The display light 71 and the LCD 72 are light emitting means for displaying various types of information and located on the not-shown surface of the fire receiver RE1. The display light 71 is, for example, an electric power source lamp, a fire indicating lamp, a test lamp, an abnormality indicating lamp, or the like. Further, the LCD 72 is a display capable of performing predetermined character display, and therefore displays detailed information relating to the location at which a fire has developed, and the like. Display may also be performed using symbols or marks as a substitute for the characters.

The display driver portion 70 drives the display light 71 and the LCD 72 in response to a pulse control signal output by the CPU 10. A light emitting diode, for example, is used as the display light 71. Although not shown in detail, a switching transistor is connected in series to the display light 71, and lighting control of the display light 71 is performed by turning the transistor on and off. Further, the LCD 72 uses a backlight method, and lighting control of the backlight is performed similarly to that of the light emitting diode discussed above.

The brightness controlling manual set switch 91 is a switch that directs the display light 71 and the LCD 72 to become darker, and conversely, brighter, and is located on the surface of the fire receiver RE1.

Note that the brightness changing means is formed by the CPU 10 and the ROM 20 such that the light emitting means such as the display light 71 and the LCD 72 are changed in brightness to have a given value.

The CPU 10 and the ROM 20 control the overall fire receiver RE1 in response to information on the state detected by the circuit control portions LC1, LC2, LC3 and LC4, and also form supervisory controlling means in which state information is displayed in LCD 72 by at least one language from among a plurality of languages.

The dip switch 51 forms language setting means in which at least one language from among the plurality of languages is set as a language which must be displayed in the LCD 72.

Figure 2:
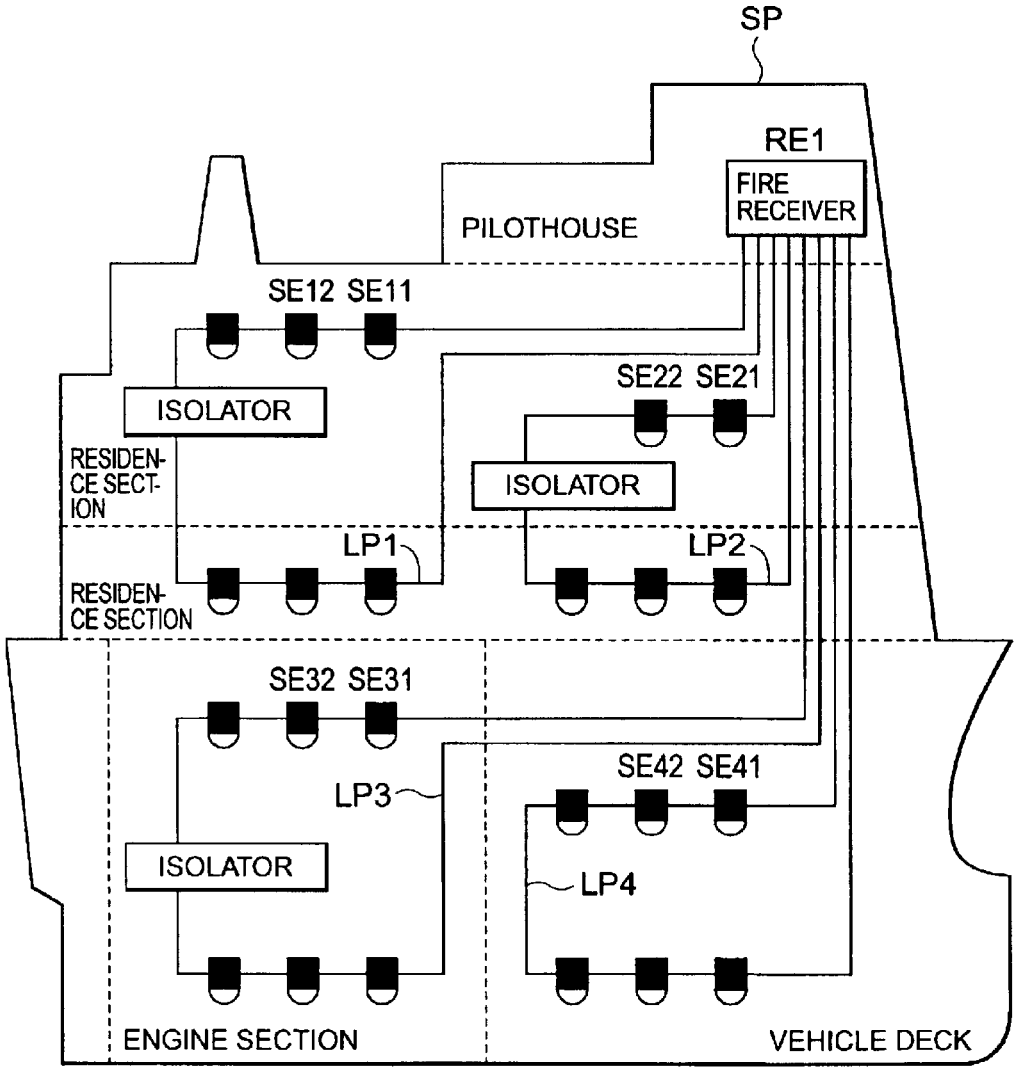
FIG. 2 is a diagram showing the overall configuration of a fire alarm system installed in a ship.

FIG. 2 shows the overall structure of a fire alarm system installed in a ship SP.

The fire receiver RE1 is installed in a pilothouse, the signal lines LP1 and LP2 are installed in a residence section, the signal line LP3 is installed in an engine room, and in addition, the signal line LP4 is installed on a vehicle deck.

The operation of Embodiment 1 is explained next with reference to the signal waveform diagram of FIG. 3.

First, if the surrounding environment of the fire receiver RE1 is bright in the daytime, then an operator manually turns on the brightness controlling manual set switch 91 so as to see the display of the display light 91 even though it is bright. The CPU 10 detects that the switch 91 has been turned on, and outputs a pulse control signal S1 having a duty ratio of 80% to the display driver portion 70, as shown in FIG. 3. The display driver portion 70 accordingly applies a voltage V having an average voltage of 80% to the display light 71, and the display light 71 shines brightly.

On the other hand, the surrounding environment of the fire receiver RE1 becomes dark at night, and the display light 71 can be sufficiently seen even being set dim. Moreover, the display 71 is also made dim in order to eliminate the difficulty of seeing outside from the pilothouse due to the bright display 71 for cases in which the fire receiver RE1 is set up in the pilothouse of the ship. In this case the switch 91 is turned off. The CPU 10 detects the off state of the switch 91, and outputs a pulse control signal S1 having a duty ratio of 30% to the display driver portion 70 as shown in FIG. 3. The display driver portion 70 accordingly applies the voltage V having an average voltage of 30% to the display light 71 in response to the pulse control signal S1, and the display light 71 shines dimly.

The LCD 72 also shines brightly or dimly in response to the on/off operation of the switch 91, similar to the display light 71.

The brightness of the light emitting means such as the display light and the LCD in the fire receiver can be manually changed in accordance with Embodiment 1, and moreover, the operation for changing the brightness is easy.

Further, the brightness of the light emitting means can be controlled by changing the duty ratio of the pulse control signal S1 in Embodiment 1, and therefore the brightness of the light emitting means can be regulated easily and in a non-stepwise manner without performing work for changing electrical components and the like.

Furthermore, two fonts are stored as font data in a data storage portion not shown in the figure, namely the Japanese character font 41 and the English character font 42, and the font to be used is set by the dip switch 51.

Words made using both of the fonts 41 and 42 are stored as terminal information in the display content table 60 such as terminal types like "Analog Smoke Detector", and installation locations like "Guest Room Number 505", as shown in FIGS. 4A to 4E. If a cause develops, which needs display, the word necessary is selected according to the font set by the dip switch 51 based on a program within the ROM 20 and displayed in the LCD 72 serving as the display means. Further, the selected word is printed by the printer 82. Similarly, for cases in which display of terminal information is necessary, a word is selected from within the display content table 60 based on the set state of the dip switch 51, and displayed in the LCD 72. Furthermore, the selected word is printed by the printer 82.

FIGS. 4A to 4E are diagrams showing a comparison of Japanese words and English words in display examples for the LCD 72 in Embodiment 1.

A case of performing display in the LCD 72 using Japanese words will be explained first.

Japanese character display is selected by the dip switch 51 in order to perform display using Japanese text. After Japanese character display is thus selected, Japanese character display will always be performed.

The term "平常監視", the date and time, and the like are displayed by using Japanese text during a normal supervisory condition, as shown in the left side of FIG. 4A. If there is a pre-alarm, the term "プレアラーム", the location name, the date and time, and the like are displayed by Japanese text as shown in the left side of FIG. 4B. For verification, display of the term "蓄積" the location name, the date and time, and the like is performed using Japanese text as shown in the left side of FIG. 4C. When there is a fire, the term "火災", the location name, the date and time, and the like are displayed by using Japanese text, as shown in the left side of FIG. 4D. If there is no response from the terminals due to a breakdown, then display of the term "無応答",the location name, and the date and time are displayed by using Japanese text as shown in the left side of FIG. 4E.

A case of performing display in the LCD 72 by using English words will now be explained.

English text display is selected by operating the dip switch 51 in order to perform display by English text when Japanese text is currently being displayed. English text display is thereafter always performed after English text display has thus been selected.

The term "Systems Normal", the date and time, and the like are displayed by using English text during a normal supervisory condition, as shown in the right side of FIG. 4A. If there is a pre-alarm, the term "Pre-Alarm", the location name, the date and time, and the like are displayed by English text as shown in the right side of FIG. 4B. For verification, display of the term "Verify", the location name, the date and time, and the like is performed using English text as shown in the right side of FIG. 4C. When there is a fire, the term "Fire", the location name, the date and time, and the like are displayed by using English text, as shown in the right side of FIG. 4D. If there is no response from the terminals, then display of the term "No Answer", the location name, and the date and time are displayed by using English text as shown in the right side of FIG. 4E. side of FIG. 4E.

Note that, among the display content in FIGS. 4B to 4E, a term "ADDR.L3-03" denotes a terminal address which corresponds to a place where a cause is generated, which must be displayed by the fire receiver RE1. In this display, "ADDR.L3-03" shows Address No. 3 of Loop No. 3, and display is performed without being dependent on the language in use, so that even if there is no terminal information, the installation location can be identified.

The display of state information in the fire receiver is made multi-lingual in accordance with Embodiment 1, and the state information is displayed in the language selected by the operator, and therefore response to a fire or the like can be performed immediately, even for cases in which a plurality of languages are used by the operators. This is therefore optimal if the nationality of the owners or the operators is not fixed, and for utilization in systems for ships that travel around the world.

Note that every time a cause that needs display develops in Embodiment 1, the state of the dip switch 51 is referred to, and a distinction is made for which display language to use, and switching of the display language may be performed as needed. It is also possible to refer to the state of the dip switch 51 only when the power is turned on, and to store that state in the RAM 30, thus fixing the display language.

Further, when displaying the fire location after a fire develops, display of the location of the detectors as the terminal information is made multi-lingual, with display of "客室 5 0 5 号室" in Japanese text and "Guest Room Number 505" in English text, for example. Confirmation of the location at which the fire has developed can therefore be performed accurately.

In addition, display of a terminal type for the detectors and the like as terminal information is also made multi-lingual, for example "光電アナログ感知器" displayed by Japanese text and "Analog Smoke Detector" displayed by English text, thus making it possible to accurately grasp the type of device which detects a fire.

Note that Embodiment 1 is also effective for cases in which the fire receiver is installed under an environment in which not only Japanese workers but also non-Japanese workers operate and supervise the fire receiver within Japan.

Further, character fonts other than English character fonts may also be used as substitutes for the English character font. In addition, three or more character fonts may also be prepared. It is necessary to add words corresponding to the program within the ROM 20 corresponding to the display causes or to take other measures in this case. The addition of words corresponding to the display causes can be performed easily by using a writable memory means such as an EEPROM as a substitute for the ROM 20. It is thus possible to transform English text to Chinese text, for example, or to German text, French text, and the like in accordance with this structure. Note that preparation is also necessary at this time for changing or adding character fonts.

Note that although language switching is performed by operating the dip switch 51 in Embodiment 1, changeover switches may be located on the surface of the fire receiver, thus realizing easy switching, when there are various languages in use by the operators who refer to the surface panel due to use mode of a ship. Furthermore, the dip switch 51 may also be provided in a location that is not easily found within a housing in order to prevent the settings from being tampered, and to prevent an easy switch over.

Further, a flash memory not shown in the figures may be prepared, and changes in the state of each type of terminal device, and operations on the panel of the fire receiver RE1 may each be stored in the flash memory chronologically as events.

If a menu list is displayed in the LCD 72, an event log menu is selected, and in addition, an event log display is selected by operation on the panel surface of the fire receiver RE1, then the most recent 100 events, for example, are displayed in the LCD 72 in chronological order. A scrolling display can also be performed by using a scroll key. Therefore, even if the event display data is large in comparison with the size of the LCD 72 display screen, the entire event can be confirmed by using the scroll key. Further, if event log printing is selected from the event log menu, then the most recent 100 events are printed consecutively from the printer 82.

Furthermore, non-display registration may be set for each event stored in the flash memory, and unnecessary event display can be inhibited. The display content is thus simplified, and only the required events are displayed swiftly. However, data for all of the events remains in the flash memory, an operator having specific operation qualifications can display all of the events by entering a password or the like, and the overall history can be reviewed. Further, a readout means such as a personal computer can be connected to a specific terminal of the fire receiver, and all of the event data within the flash memory can be read out without displaying the events on the LCD 72.

Operations for non-display of specific event data may be practiced when returning to a normal state after a fire has developed or a series of testing operations has been performed. Event data for the series can be made into non-display data collectively.

The number of events able to be displayed chronologically in the LCD 72 is not limited to 100, and can be suitably set.

Further, all types of non-volatile memory may also be used as a substitute for the flash memory.

Embodiment 2

Figure 5:
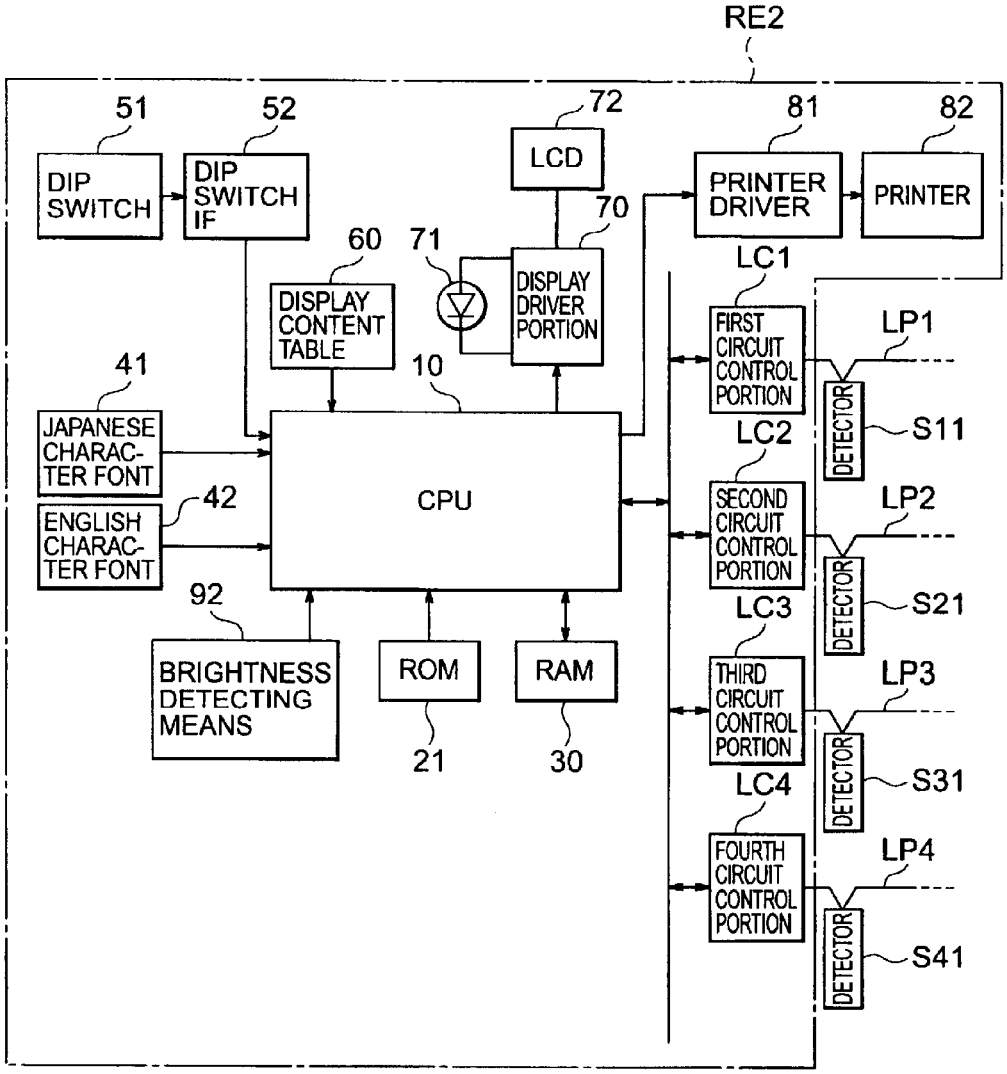
FIG. 5 is a block diagram showing the structure of a fire receiver RE2 according to Embodiment 2.

FIG. 5 is a block diagram showing the structure of a fire receiver RE2 relating to Embodiment 2.

The fire receiver RE2 is basically the same as the fire receiver RE1 shown in FIG. 1, and differs from the fire receiver RE1 in that a brightness detecting means 92 is used as a substitute for the brightness controlling manual set switch 91, and that a ROM 21 is used as a substitute for the ROM 20.

The brightness detecting means 92 detects the brightness in the surrounding environment of the fire receiver RE2.

A computer program which makes the CPU 10 operate the fire receiver RE2 as discussed below is stored in the ROM 21.

Further, the ROM 21 and the CPU 10 form a brightness controlling means for controlling the brightness of the light emitting means in response to the brightness in the surrounding environment of the fire receiver RE2 detected by the brightness detecting means 92. The brightness controlling means increases the brightness of the light emitting means if the surrounding environment of the fire receiver RE2 is bright, and conversely decreases the brightness of the light emitting means if the surrounding environment of the fire receiver RE2 is dark.

Operation of the fire receiver RE2 will now be explained.

First, in the daytime, the brightness detecting means 92 detects the brightness in the surrounding environment of the fire receiver RE2 and outputs a signal that indicates the brightness. The CPU 10 determines that the surrounding environment of the fire receiver RE2 is bright from this signal, and outputs the pulse control signal S1 having an 80% duty ratio to the display driver portion 70 as shown in FIG. 3. The display driver portion 70 thus applies the voltage V having an average voltage of 80% to the display light 71, and the display light 71 shines brightly. The display light 71 therefore shines brightly so that display of the display light 71 can be seen even if the surrounding environment of the fire receiver RE2 is bright.

Figure 3:
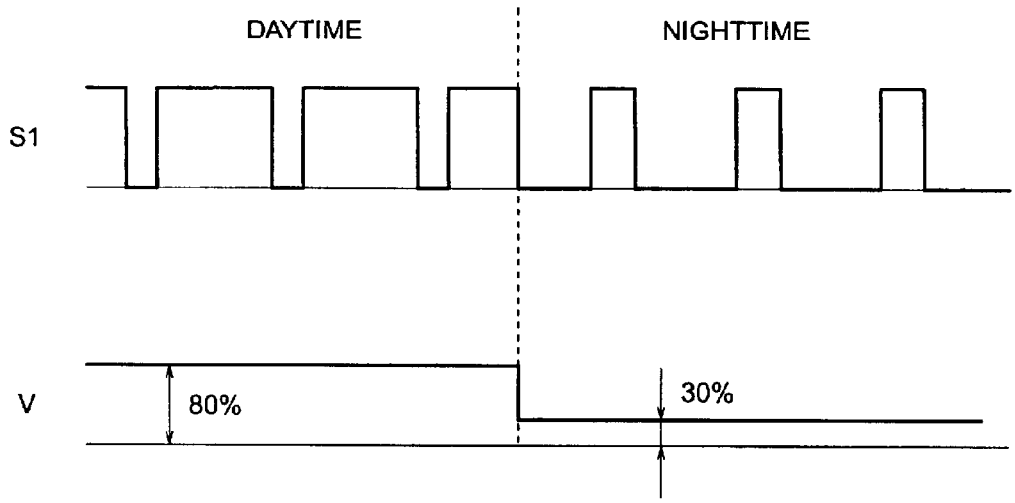
FIG. 3 is a signal waveform diagram showing the operation of Embodiment 1.

On the other hand, during the night, the CPU 10 determines that the surrounding environment of the fire receiver RE2 is dark, and outputs the pulse control signal S1 having a 30% duty ratio to the display driver portion 70 as shown in FIG. 3. The display driver portion 70 thus applies the voltage V having an average voltage of 30% to the display light 71, and the display light 71 shines dimly. The surrounding environment of the fire receiver RE2 is dark, and therefore the fire receiver RE2 can be seen sufficiently even if the display light 71 is dim. Moreover, even if the fire receiver RE2 is installed in a pilothouse of a ship, the difficulty in seeing outside when looking from the pilothouse due to the bright display light 71 can be eliminated.

The LCD 72 also shines brightly and dimly in response to the brightness of the surrounding environment of the fire receiver RE2, similar to the display light 71.

The brightness of the light emitting means such as the display light and the LCD display in the fire receiver can be automatically regulated in the fire receiver RE2.

Further, the brightness of the light emitting means can be controlled by changing the duty ratio of the pulse control signal S1 with the fire receiver RE2, and therefore the brightness of the light emitting means can be regulated easily and in a non-stepwise manner.

Note that the value of a DC voltage applied to the above light emitting means may also be changed as a substitute for adjusting the brightness of the light emitting means by changing the duty ratio of the pulse control signal S1 applied to the light emitting means in Embodiments 1 and 2. For example, a resistor having a predetermined value may be connected in series with the light emitting means, and a transistor may be connected in parallel with the resistor. The value of the voltage applied to the light emitting means may be changed by turning the transistor on and off.

Furthermore, a light emitting diode or an LCD can be used as the light emitting means.

In addition, a detecting means for detecting fires and breakdowns is established in Embodiments 1and 2, and a forcing means may also be formed for forcibly controlling the brightness controlling means so that the light emitting means emits light at a predetermined brightness if the detecting means detects a fire or a breakdown, even if the surrounding environment is dark. The people in charge can thus swiftly understand the display content when a fire or a breakdown develops. The forcing means can be formed by the ROM 21 and the CPU 10.

Further, although the dim lighting is explained in each of the embodiments as being performed by applying the pulse control signal S1 having a 30% duty ratio to the display light 71, other percentages may also be employed. Furthermore, percentages other than 80% may be employed for the duty ratio of the pulse control signal S1 applied to the display means 71 when performing bright lighting, provided that the value of the duty ratio is larger than that used during dim lighting.

In addition, switching between bright lighting and dim lighting is performed by changing the duty ratio of the pulse control signal S1 input to the display light 71 in each embodiment, but switching between bright lighting and dim lighting may also be performed by changing the value of a voltage applied to, or an electric current made to flow in, the display light 71. In particular, for the cases in which the distinction between bright and dim lighting is made by changing the duty ratio, the light which is turned on cannot be taken in by human eyes if the width of the pulse applied to the display light 71 becomes short, and therefore the value of the voltage or the electric current of the pulse during application may be lowered in order to achieve a darker lighting. The range of possible settings is thus made wide by combining control in which only the duty ratio is changed, and control in which the value of the voltage and the value of the electric current are changed.

As described above, the present invention has an effect such that the brightness of the light emitting means such as the display light or the LCD display in the fire receiver can be adjusted from outside the fire receiver, and in addition, the brightness adjustment operation is easy.

Also, the present invention has an effect such that display content of the fire receiver is easily understood by non-Japanese operators for cases in which the fire receiver is installed in an environment under which it must be operated or observed by the non-Japanese as well as the Japanese.

What is claimed is:

1. A fire receiver comprising:

light emitting means;

supervisory control means for receiving information regarding a plurality of terminal devices including fire detectors, for performing supervisory control based on the information, and for causing said light emitting means to emit light based on the information;

brightness changing means for changing a brightness of said light emitting means based on a brightness of a surrounding environment;

detecting means for detecting an abnormality, wherein the abnormality comprises at least one of a fire and a breakdown of one of the terminal devices;

forcing means for forcibly controlling said brightness changing means such that said light emitting means emits light at a predetermined brightness if said detecting means detects the abnormality, regardless of the brightness of the surrounding environment;

displaying means; and a display content table having stored therein, in each of a plurality of languages, terminal information including installation locations and types of the terminal devices, wherein the supervisory control means reads out the terminal information from the display content table and causes said displaying means to display the terminal information.

2. A fire receiver according to claim 1, wherein said brightness changing means comprises a manual set switch, and wherein the brightness of said light emitting means can be changed by operating said manual set switch.

3. A fire receiver according to claim 1, wherein said brightness changing means comprises:

a brightness detecting means for detecting the brightness of the surrounding environment; and a brightness controlling means for controlling said light emitting means to have a predetermined brightness in response to the brightness detected by said brightness detecting means.

4. A fire receiver according to claim 1, wherein said brightness changing means changes the brightness of said light emitting means by changing a duty ratio of a pulse control signal used for driving said light emitting means.

5. A fire receiver according to claim 1, wherein said brightness changing means changes the brightness of said light emitting means by changing a value of a DC voltage used for driving light emitting means.

6. A fire receiver according to claim 1, wherein said light emitting means is a light emitting diode.

7. A fire receiver according to claim 1, wherein said light emitting means is a backlight.

8. A fire receiver according to claim 1, further comprising a surface panel to which said light emitting means is attached.

9. A fire receiver comprising:

a light emitting device;

a supervisory control circuit operable to receive information regarding a plurality of terminal devices including fire detectors, for performing supervisory control based on the information, and for causing said light emitting device to emit light based on the information;

a brightness changing circuit operable to change a brightness of said light emitting device based on a brightness of a surrounding environment;

a detecting circuit operable to detect an abnormality, wherein the abnormality comprises at least one of a fire and a breakdown of one of the terminal devices;

a forcing circuit operable to forcibly control said brightness changing circuit such that said light emitting device emits light at a predetermined brightness if said detecting circuit detects the abnormality, regardless of the brightness of the surrounding environment;

a display; and a display content table having stored therein, in each of a plurality of languages, terminal information including installation locations and types of the terminal devices, wherein the supervisory control circuit reads out the terminal information from said display content table and causes said display to display the terminal information.

10. A fire receiver according to claim 9, wherein the brightness changing circuit comprises a manual set switch, and wherein the brightness of the light emitting circuit can be changed by operating said manual set switch.

11. A fire receiver according to claim 9, wherein the brightness changing circuit comprises:

a brightness detecting circuit operable to detect the brightness of the surrounding environment; and a brightness controlling circuit operable to control said light emitting device to have a predetermined brightness in response to the brightness detected by said brightness detecting circuit.

12. A fire receiver according to claim 9, wherein said brightness changing circuit changes the brightness of said light emitting device by changing a duty ratio of a pulse control signal used for driving said light emitting device.

13. A fire receiver according to claim 9, wherein the brightness changing circuit changes the brightness of said light emitting device by changing a value of a DC voltage used for driving the light emitting device.

14. A fire receiver according to claim 9, wherein the light emitting device is a light emitting diode.

15. A fire receiver according to claim 9, wherein the light emitting device is a backlight.

16. A fire receiver according to claim 9, further comprising a surface panel to which the light emitting device is attached.

* * * * *